United States Patent [19]

Jury

[11] Patent Number: 4,510,727

[45] **Date of Patent: * Apr. 16, 1985**

[54] GRID SUPPORTED STRUCTURE

[75] Inventor: Harold R. Jury, Glynde, Australia

[73] Assignee: Ampliform Pty. Ltd., Royal Park, Australia

[ * ] Notice: The portion of the term of this patent subsequent to Aug. 2, 2000 has been disclaimed.

[21] Appl. No.: 394,280

[22] Filed: Jul. 1, 1982

[30] Foreign Application Priority Data

Jul. 8, 1981 [AU] Australia ..... PE9646

[51] Int. Cl.[3] ..... E04B 1/38

[52] U.S. Cl. ..... 52/508; 52/511; 52/672; 52/762

[58] Field of Search ..... 52/634, 635, 636, 637, 52/730, 732, 670, 672, 762, 508, 390, 385, 511

[56] References Cited

U.S. PATENT DOCUMENTS

| | | | |
|---|---|---|---|
| 2,201,504 | 5/1940 | Ruppel | 52/635 |
| 3,412,516 | 11/1968 | Lindstrom | 52/762 |
| 3,737,964 | 6/1973 | Jury | 52/635 |
| 3,740,812 | 6/1973 | Ryan | 52/635 |
| 3,962,763 | 6/1976 | Jury | 52/635 |
| 4,396,685 | 8/1983 | Jury | 52/672 |

FOREIGN PATENT DOCUMENTS

| | | | |
|---|---|---|---|
| 2242317 | 3/1974 | Fed. Rep. of Germany | 52/508 |

*Primary Examiner*—John E. Murtagh
*Assistant Examiner*—Andrew Joseph Rudy
*Attorney, Agent, or Firm*—Bert J. Lewen

[57] ABSTRACT

An expanded metal grid has beads which comprise grooves, the widest part of each said groove being wider than its mouth, and these narrow-mouth grooves are engaged by the heads of panel supports which support panels (for example, louvres).

7 Claims, 6 Drawing Figures

GRID SUPPORTED STRUCTURE

This invention relates to a structure wherein elements are supported either directly or indirectly by grid means.

BACKGROUND OF THE INVENTION

There are many reasons why it is desirable for a structure to be in a panel form, and for example, a building or other structure may comprise a plurality of "modules" which are secured together. For example, in the erection of a wall or ceiling of a building, it is most desirable that the walls or ceilings comprise panels which are readily and inexpensively interengaged with one another so as to avoid expensive "on site" work, and in order to achieve this, it is in turn desirable that interengaging means be readily assembled within a panel itself. If a louvre panel is required, it is desirable that the louvre panel should also be in the form of a sub-assembly which can be secured to a building or other structure.

BRIEF SUMMARY OF THE INVENTION

In this invention, an expanded metal grid has beads which comprise grooves, the widest part of each said groove being wider than its mouth, and these narrow-mouth grooves are engaged by the heads of panel supports which support panels (for example, louvres).

More specifically, this invention consists of an expanded metal grid having a plurality of beads which are non-rectilinear and are interconnected by rows of webs, the webs of any one row being staggered with respect to the webs of the next adjacent row, the said beads comprising grooves, the widest part of each said groove being wider than its mouth, a plurality of panel support brackets having a relatively narrow portion entering the mouth of a said groove and a head engaging and retained by its said re-entrant surfaces, and panels carried by said support brackets.

The grooves may be defined by adjacent beads where they are joined by the webs, or may be within the beads themselves.

In some embodiments of the invention the panel members are directly supported by the expanded metal grid, while in other embodiments, the panel members are supported by panel supports themselves carried by the grid. In still further embodiments, the grid means can itself be provided with stiffeners which will inhibit deflection, due for example to wind loadings.

BRIEF DESCRIPTION OF THE DRAWINGS

Several embodiments of the invention are described hereunder in some detail with reference to and are illustrated in the accompanying drawings, in which.

Figure 1:
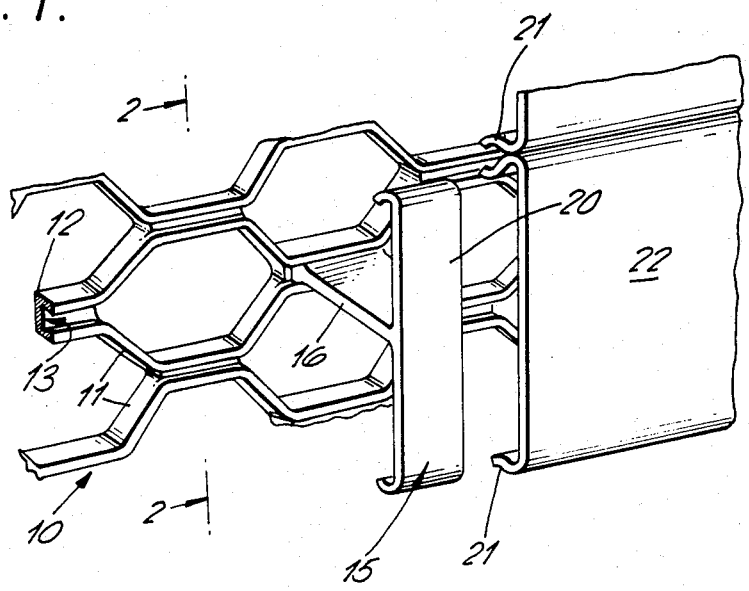
FIG. 1 is a fragmentary perspective view of a grid which supports light weight metal cladding.

In the first embodiment of FIG. 1 a grid 10 is formed by expanding metal by the process disclosed in the U.S. Pat. No. 3,740,812 (invented by the inventor herein). The grid 10 has a plurality of beads 11 interconnected by webs 12, the webs 12, defining, with the beads 11, grooves 13. The webs of any one edge are staggered with respect to the webs of the next adjacent edge as shown in FIG. 1, and the side faces of the beads slope with respect to one another forming re-entrant faces at the locality of the grooves such that each groove 13 has its mouth narrower than its base and is "dove-tail" shape in section.

There are provided a plurality of panel support brackets 15 each having a relatively narrow portion 16 entering the mouth of a respective said groove 13, and having a head 17 engaging and retained by the groove re-entrant surfaces.

Figure 2:
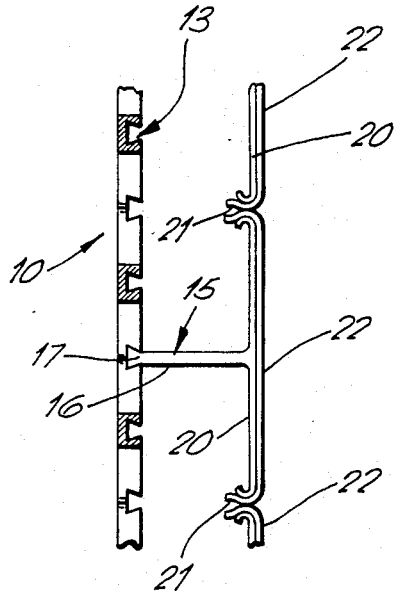
FIG. 2 is a section taken on plane 2—2—2—2 of FIG. 1.

In the embodiment of FIGS. 1 and 2, each panel support bracket 15 is of general T-shape and has a flange 20 which is engaged as shown in FIG. 2 by inturned flanges 21 of sheet metal cladding strips 22, and these can be readily positioned or removed by resilient deformation of the flanges 21.

Figure 3:
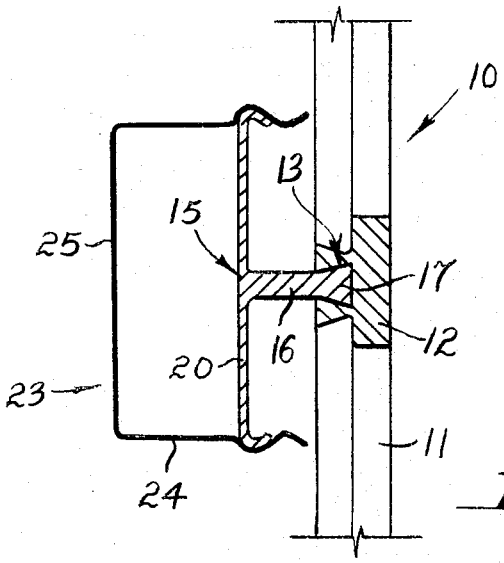
FIG. 3 shows a second embodiment in section, similar to FIG. 2 but drawn to a larger scale, showing support means for a "deep flange" cladding which is stiff over a long span.

In some embodiments it is desirable to have cladding which is capable of spanning a considerable distance such that the cladding itself imparts mechanical strength to the grid. In FIG. 3, the panel support brackets 15 again have flanges 20 as in the first embodiment, but these are engaged by channel shaped cladding 23, the cladding 23 having flanges 24 and a web 25 which impart considerable strength.

Figure 4:
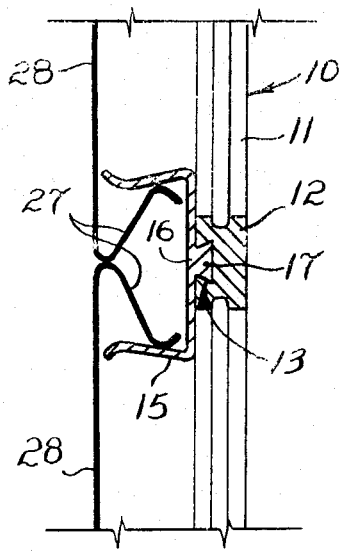
FIG. 4 shows a third embodiment, similar to FIG. 3, but illustrating "shallow flange" cladding.

On the other hand, there is sometimes a requirement for the cladding to be close to the grid, and in the third embodiment of FIG. 4, the panel support brackets 26 are themselves shallow U-shape brackets which engage shallow flanges 27 of cladding strips 28, the strips being of resilient sheet metal.

Figure 5:
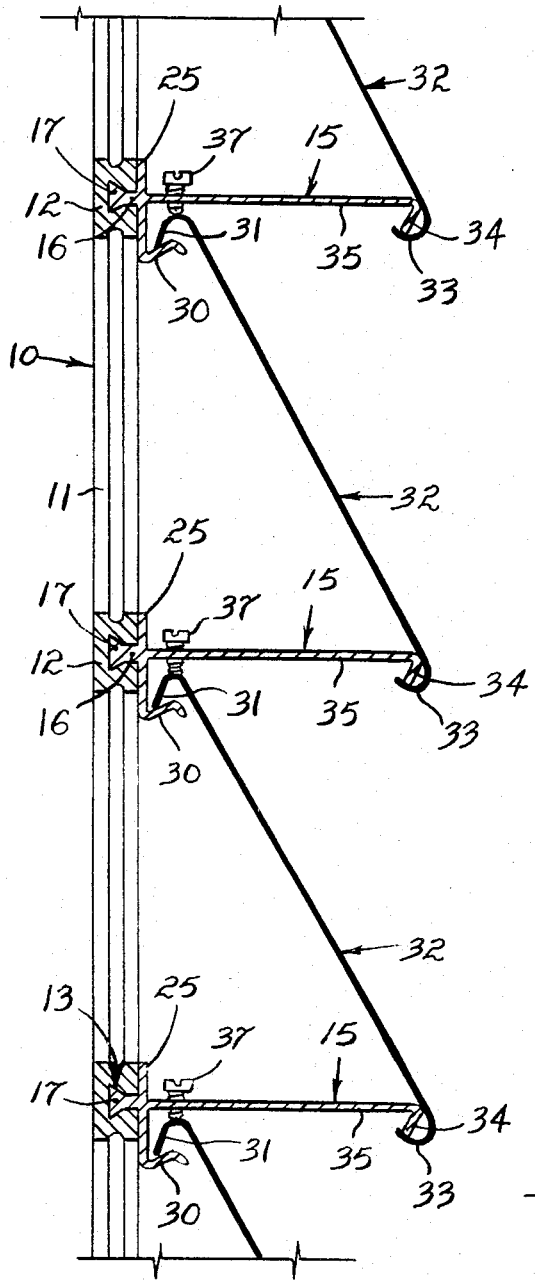
FIG. 5 shows a fourth embodiment wherein the panels are louvre panels.

The above embodiments have been described with respect to cladding required to be used for enclosing a grid and to be separate therefrom. Further the invention is not limited to cladding of this type and the panels can, for example, be louvre panels, and in FIG. 5 there is shown a structure wherein each panel support bracket 15 is provided with a base 25 from which extends a short limb 30 having a hook-like portion 34 which engages a return flange 31 of a respective louvre panel 32, the louvre panel 32 also having a return flange 33 extending along its lower edge, and this engages over a hook-like end portion (also designated 34) of a long limb 35 of the panel support bracket 15 which also extends from base 25. Head 17 and narrow portion 16 extend from the other side of the base 25. In some instances it is desirable to provide additional means to reduce the possibility of rattles developing under windy conditions, and to firmly clamp the louvre panels 32, use is made of screw threaded fasteners 37 which threadably engage respective long limbs 35 and clamp the return flanges 31 against the short limbs 30 to the respective brackets 15.

Figure 6:
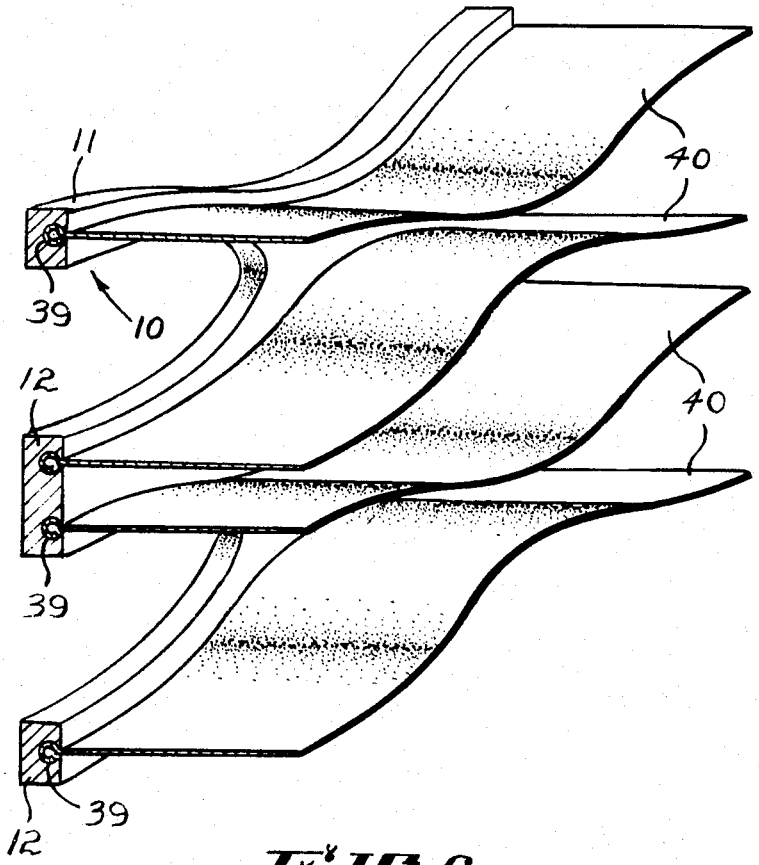
FIG. 6 shows a fifth embodiment wherein panel members are secured directly to a grid.

In some instances it is not necessary to make use of separate panel support brackets 15 and in the last embodiment described in FIG. 6 the grid 10 has its beads 11 each formed with an independent narrow mouth channel 39, and this channel 39 is engaged by a part circular edge which comprises the head of a sheet metal strip 40. This is located in its respective channel 39

(being an easy slide fit therein) before the grid is expanded, such that the strips 40 bend along with the beads 11 upon expansion of the grid, and thereby provide an aesthetically pleasing sun-screen assembly as illustrated in FIG. 6.

In all the above embodiments it will be noted that the grid performs the function of a support member which provides an effective and inexpensive means for assembly of a structure. If the grid supported structure is formed in accordance with any one of the above embodiments, a very high strength to weight ratio can be achieved and an effective panel can be produced for relatively low cost. The grid also performs a secondary function of providing a support for a heat or sound insulating panel. Even though the panel members can be constructed to be of light weight, they can be so spaced and can so grip the supports that they impart considerable strength to the grid and in many instances there is no need to use stiffening channels. The "rear" appearance of the assembly can be made aesthetically very pleasing as for example can be seen in FIG. 6 wherein the entire assembly is aesthetically pleasing from both front and back. While the embodiments of FIGS. 2 to 6 have been related with respect to the "AMPLIFORM" process ("AMPLIFORM" being a registered Trade Mark), quite clearly the aluminium extrusion can be replaced by a rolled steel section which has upwardly extending rib portions which can be forced downwardly under pressure to achieve a satisfactory interengagement of the grid with either the panels or the panel supports as the case may be. Clearly also, the cladding material can be widely varied and can be quickly changed from one decor to another.

I claim:

1. Grid supported structure comprising:

an expanded metal grid having a plurality of beads which are non-rectilinear and are interconnected by rows of webs, the webs of any one row being staggered with respect to the webs of the next adjacent row, the said beads comprising narrow-mouth grooves, each groove comprising side faces which slope with respect to one another forming re-entrant faces running from the mouth of each groove;

a plurality of panel support brackets having a relatively narrow portion entering the mouth of said groove and a head engaging and retained by said re-entrant faces, and panels carried by said support brackets.

2. Grid supported structure according to claim 1 wherein the side faces of said beads slope with respect to one another to be re-entrant faces which, along with the grid webs, define said grooves.

3. Grid supported structure according to claim 1 or claim 2 wherein each said panel support means is of T-shape, the web of the support comprising said narrow portion and head, each said panel comprising a pair of spaced flanges of a cladding strip which engage the edges of a flange of said panel support by resilient deformation of at least one of said panel support and panel.

4. Grid supported structure according to claim 3 wherein each said panel is of U-shape in cross-section and comprises a web and a pair of spaced parallel flanges which extend from the web and engage said panel support.

5. Grid supported structure according to claim 1 or claim 2 wherein each said panel support means is of U-shape in section and has a web and two flanges, and wherein said narrow portion and said head extend from one side of its web, the flanges of said support means extending from the other side of said web, and wherein each said panel is also of U-shape in section and also has a web and two flanges, the flanges of said panel engaging the flanges of said support means by resilient deformation.

6. Grid supported structure according to claim 1 or claim 2 wherein each said panel support means comprises a base having said narrow portion and head extending from one side thereof, and both a long limb and a short limb extending from the other side thereof, each said limb terminating in a hook-like portion, each said panel being a louvre having a pair of return flanges extending along its edges which engage the hook-like portions of said support means, and are retained in an array thereby.

7. Grid supported structure according to claim 1 wherein each said bead comprises a surface defining a groove which extends along its length, and each said panel comprises a metal strip having a head retained by the groove surface, the metal strip having a shape which is formed by expansion of the grid.

* * * * *